US010292455B2

(12) United States Patent
Ikenaka

(10) Patent No.: US 10,292,455 B2
(45) Date of Patent: May 21, 2019

(54) SHOE UPPER AND METHOD FOR PRODUCING SHOE UPPER

(71) Applicant: Shima Seiki Mfg., Ltd., Wakayama-shi, Wakayama (JP)

(72) Inventor: Masamitsu Ikenaka, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 451 days.

(21) Appl. No.: 14/407,129

(22) PCT Filed: May 22, 2013

(86) PCT No.: PCT/JP2013/064273
§ 371 (c)(1),
(2) Date: Dec. 11, 2014

(87) PCT Pub. No.: WO2014/013790
PCT Pub. Date: Jan. 23, 2014

(65) Prior Publication Data

US 2015/0173458 A1 Jun. 25, 2015

(30) Foreign Application Priority Data

Jul. 17, 2012 (JP) ..... 2012-158884

(51) Int. Cl.
*D04B 1/06* (2006.01)
*D04B 1/10* (2006.01)
(Continued)

(52) U.S. Cl.
CPC ..... *A43B 23/0205* (2013.01); *A43B 1/04* (2013.01); *A43B 23/0245* (2013.01);
(Continued)

(58) Field of Classification Search
CPC ..... A43B 1/04; A43B 23/025; A43B 23/0245; D04B 1/126; D04B 1/22; D04B 1/06;
(Continued)

(56) References Cited

U.S. PATENT DOCUMENTS 2,180,593 A * 11/1939 Kugelman ..... D04B 9/46 66/187
4,757,697 A * 7/1988 Baseggio ..... D04B 7/26 66/128
(Continued)

FOREIGN PATENT DOCUMENTS

EP 0632972 A1 1/1995
EP 2116642 A1 11/2009
(Continued)

OTHER PUBLICATIONS

Extended European Search Report dated Mar. 3, 2016, in application No. 13819529.2-1710, 8 pages.

*Primary Examiner* — Anna K Kinsaul
*Assistant Examiner* — Cameron A Carter
(74) *Attorney, Agent, or Firm* — Rothwell, Figg, Ernst & Manbeck, P.C.

(57) ABSTRACT

There is provided a shoe upper that can be produced with high productivity. A heel cover portion (2) and a body portion (3) of a shoe upper (1) are integrally formed in a seamless manner by a knitting pattern. In the top section, a portion having a knitting width of greater than or equal to a predetermined width from an upper end to a lower end, at a position corresponding to a heel of a wearer, is assumed as the heel cover portion (2), and a portion including a remaining portion of the top section, excluding the heel cover portion (2), and the bottom section is assumed as the body portion (3), where an end in a knitting width direction of the heel cover portion (2) and an end in a wale direction of the body portion (3) are connected at positions of edges (L2, L3)
(Continued)

on a side surface of the shoe upper (1) of the edges (L1 to L3) to become the boundary lines of the heel cover portion (2) and the body portion (3). As a result, directions of stitches of the heel cover portion (2) and the body portion (3) are oriented in a height direction and a length direction, respectively, of the shoe upper (1), whereby a three-dimensional shoe upper (1) is obtained.

4 Claims, 2 Drawing Sheets

(51) Int. Cl.

| | |
|---|---|
| ***D04B 1/26*** | (2006.01) |
| ***D04B 7/18*** | (2006.01) |
| ***D04B 7/30*** | (2006.01) |
| ***D04B 7/32*** | (2006.01) |
| ***A43B 23/02*** | (2006.01) |
| ***A43B 1/04*** | (2006.01) |
| ***D04B 1/22*** | (2006.01) |

(52) U.S. Cl.
CPC ..... *D04B 1/106* (2013.01); *D04B 1/108* (2013.01); *D04B 1/22* (2013.01); *D10B 2403/0332* (2013.01); *D10B 2501/043* (2013.01)

(58) Field of Classification Search
CPC . D04B 1/108; D04B 1/26; D04B 7/18; D04B 7/30; D04B 7/32; D10B 2501/43
USPC ..... 36/25 R, 45, 48, 83, 84; 2/241; 66/171, 66/178 R, 70
See application file for complete search history.

(56) References Cited

U.S. PATENT DOCUMENTS 4,909,048 A * 3/1990 Stoll ..... D04B 7/26 66/127
7,076,973 B1 * 7/2006 Chesebro, Jr. ..... A41B 11/00 2/239
7,931,972 B2 * 4/2011 Hsu ..... C04B 41/483 428/451
8,959,959 B1 * 2/2015 Podhajny ..... A43B 1/04 66/177
2005/0115284 A1 * 6/2005 Dua ..... A43B 1/04 66/178 R
2005/0193592 A1 * 9/2005 Dua ..... A43B 1/04 36/45
2006/0144097 A1 * 7/2006 Langer ..... A41B 11/00 66/178 R
2008/0041113 A1 * 2/2008 Mori ..... A41B 11/02 66/54
2008/0110048 A1 * 5/2008 Dua ..... A43B 1/04 36/45
2008/0110049 A1 * 5/2008 Sokolowski ..... A43B 3/0031 36/50.1
2008/0179030 A1 * 7/2008 O'Connor ..... D21F 1/0036 162/201
2009/0314037 A1 * 12/2009 Naka ..... D04B 1/22 66/17
2010/0154256 A1 * 6/2010 Dua ..... A43B 1/04 36/25 R
2012/0255201 A1 * 10/2012 Little ..... A43B 1/04 36/84
2014/0238083 A1 * 8/2014 Meir ..... D04B 15/90 66/64

FOREIGN PATENT DOCUMENTS

| | | |
|---|---|---|
| EP | 2157220 A1 | 2/2010 |
| JP | 4-32103 | 3/1992 |
| JP | 4-86043 | 7/1992 |
| WO | 2010/080182 A1 | 7/2010 |
| WO | 2012-512698 A | 6/2012 |

* cited by examiner

SHOE UPPER AND METHOD FOR PRODUCING SHOE UPPER

CROSS REFERENCE TO RELATED APPLICATION

This application is a 35 U.S.C. 371 National Phase Entry Application from PCT/JP2013/064273, filed May 22, 2013, which claims the benefit of Japanese Patent Application No. 2012-158884 filed on Jul. 17, 2012, the disclosure of which is incorporated herein in its entirety by reference.

TECHNICAL FIELD

The present invention relates to a shoe upper, and a method for producing the shoe upper.

BACKGROUND ART

A shoe includes a shoe upper and an outer sole. The shoe upper includes a top section that covers an instep side portion of a wearer, and a bottom section that covers a sole of a foot. Recently, attempts have been made to form the top section of the shoe upper from one knitted fabric to produce the shoes with high productivity. For example, in Patent Document 1, the top section of the upper in a planar developed state is formed with one knitted fabric, and such top section is joined to an outer sole made from synthetic resin and the like along with the bottom section of the upper to complete the shoes.

PRIOR ART DOCUMENT

Patent Document

[Patent Document 1] Japanese Laid-Open Patent Application Publication No. 2012-512698

SUMMARY OF THE INVENTION

Problem to be Solved by the Invention

However, the shoes of Patent Document 1 still can be improved in terms of productivity.

Firstly, in Patent Document 1, the top section of the upper is obtained by cutting one knitted fabric, or the top section is obtained by performing shape knitting. In the former case, a cutting step and a sewing step for forming the top section to a three-dimensional shape are necessary, and in the latter case, the cutting step is not necessary but a similar sewing step is necessary.

Secondly, when combining the top section of the upper with the bottom section of the upper and the outer sole, the alignment of the top section is complex, which may lower the productivity. The alignment is complex because the top section in the planar developed state needs to be joined at a predetermined position of the bottom section and the outer sole while being formed to a three-dimensional shape.

The present invention has been made in light of the foregoing, and an object of the present invention is to provide a shoe upper that can be produced with high productivity. Another object of the present invention is to provide a method for producing the shoe upper of knitting the shoe upper of the present invention in a seamless manner with a flat knitting machine.

Means for Solving the Problems

A shoe upper of the present invention comprises a top section and a bottom section; where the top section and the bottom section are integrally formed in a seamless manner by a knitting pattern. Assuming a portion having a knitting width of greater than or equal to a predetermined width from an upper end to a lower end of the top section, at a position corresponding to a region between an Achilles' tendon and a heel of a wearer, is a heel cover portion, and a portion including a remaining portion of the top section, excluding the heel cover portion, and the bottom section is a body portion, the heel cover portion and the body portion are integrally formed in a seamless manner by a knitting pattern. An end in a knitting width direction of the heel cover portion and an end in a wale direction of the body portion are connected at a position of an edge (side edge) arranged on a side surface of the shoe upper, out of edges to become boundary lines of the heel cover portion and the body portion, so that a direction (i.e., wale direction) of stitches of the heel cover portion is oriented in a height direction of the shoe upper and a direction (i.e., wale direction) of stitches of the body portion is oriented in a length direction of the shoe upper.

As described in the method for producing the shoe upper of the present invention to be described later, when first knitting the heel cover portion out of the heel cover portion and the body portion, the starting end in the wale direction of the body portion is connected to the end in the knitting width direction of the heel cover portion at the position of the side edge. On the other hand, when first knitting the body portion, the terminating end in the wale direction of the body portion is connected to the end in the knitting width direction of the heel cover portion at the position of the side edge.

According to one aspect of the shoe upper of the present invention, the heel cover portion is formed to a shape along a bulge of the heel of the wearer by widening a knitting width from the upper end toward the lower end of the top section of the upper.

According to one aspect of the shoe upper of the present invention, a portion (i.e., portion in the vicinity of an ankle on the foot insertion opening side) corresponding to the ankle of the wearer on an upper end side of the body portion is curved toward a lower end side (i.e., bottom section side of the upper) of the body portion to avoid the ankle; and the curved shape is formed by reducing the number of stitches in the knitting width direction of the body portion at a position on the upper end side of the top section of the upper.

According to one aspect of the shoe upper of the present invention, the heel cover portion is formed by a reinforcement knitting yarn for increasing strength of the heel cover portion; and a portion adjacent to the heel cover portion in the body portion is formed by intarsia knitting using the reinforcement knitting yarn.

According to one aspect of the shoe upper of the present invention, the body portion is formed to be left-right asymmetric to become a shape that lies along an entire shape of a foot of the wearer; which left-right asymmetrical shape is formed by increasing/decreasing the number of stitches in a knitting width direction in an instep side portion of a top section region of the upper (region corresponding to the top section of the upper) and an bottom section region of the upper (region corresponding to the bottom section of the upper) of the body portion.

According to one aspect of the shoe upper of the present invention, a reinforcement marginal section, arranged at a marginal portion of a foot insertion opening of the shoe upper to reinforce the marginal portion is further arranged; wherein a direction of stitches of the reinforcement marginal section is oriented in a height direction of the shoe upper.

A method for producing a shoe upper of the present invention is a method for producing a shoe upper for producing a shoe upper comprising a top section and a bottom section. The method for producing the shoe upper of the present invention assumes a portion having a knitting width of greater than or equal to a predetermined width from an upper end to a lower end of the top section, at a position corresponding to a region between an Achilles' tendon and a heel of a wearer, as a heel cover portion, and a portion including a remaining portion of the top section, excluding the heel cover portion, and the bottom section as a body portion, and carries out knitting according to any one of the following procedures using a flat knitting machine which includes at least a pair of a front and a back needle bed and in which stitches formed on each of the needle beds are transferrable.

[1] After knitting the heel cover portion, a starting end in a wale direction of a bottom section region of the body portion is knitted following a terminating end in a wale direction of the heel cover portion, and a starting end in a wale direction of a top section region of the body portion is knitted following an end in a knitting width direction of the heel cover portion.

[2] After knitting the body portion from a toe side of the shoe upper, an end in a knitting width direction of the heel cover portion is joined to a terminating end in a wale direction of the top section region of the body portion while knitting the heel cover portion following the terminating end in the wale direction of the bottom section region of the body portion.

Effect of the Invention

The shoe upper of the present invention is produced through the method for producing the shoe upper of the present invention and excels in productivity compared to the conventional shoe upper. This is because the material is barely wasted as the top section and the bottom section, which configure the shoe upper, are integrally knitted, and furthermore, the alignment of the top section and the bottom section, which is necessary in the prior art, can be omitted. Furthermore, in the shoe upper of the present invention, the end in the knitting width direction of the heel cover portion and the end (may be terminating end or may be starting end) in the wale direction of the body portion are connected, so that the heel cover portion and the body portion are three-dimensionally connected and the shoe upper is three-dimensionally formed. The stitches of the body portion are oriented in the length direction of the shoe upper and the stitches of the heel cover portion are oriented in the height direction of the shoe upper, so that satisfactory appearance of the shoe upper is realized.

In the shoe upper of the present invention, the shoe upper is formed to lie along the shape of the foot of the wearer by increasing the knitting width of the heel cover portion, curving the portion in the vicinity of the ankle of the body portion toward the bottom section side, forming the body portion to be left-right asymmetric and the like, so that the shoe upper can be more comfortably worn.

In the shoe upper of the present invention, the heel cover portion and a part of the body portion adjacent to the heel cover portion are knitted with the reinforcement knitting yarn, so that the strength of the portion knitted with the reinforcement knitting yarn can be increased. As a result, the portion knitted with the reinforcement knitting yarn plays the role of a heel counter for fitting the shoe upper on the foot when wearing the shoe upper, so that the shoe upper can be more comfortably worn.

In the shoe upper of the present invention, the reinforcement marginal section is formed, so that a shoe upper in which the contour shape of the marginal portion of the top section in the vicinity of the foot insertion opening is stabilized and the foot can be easily inserted from the foot insertion opening, can be obtained.

DESCRIPTION OF EMBODIMENTS

An embodiment of a shoe upper and a method for producing the shoe upper according to the present invention will be hereinafter described based on the drawings. A two-bed flat knitting machine which includes at least a pair of a front and a back needle bed, and in which stitches can be transferred between the front and back needle beds is used for producing the shoe upper. The flat knitting machine to be used is, of course, not limited to the two-bed flat knitting machine, and may be a four-bed flat knitting machine, for example.

First Embodiment

Figure 1:
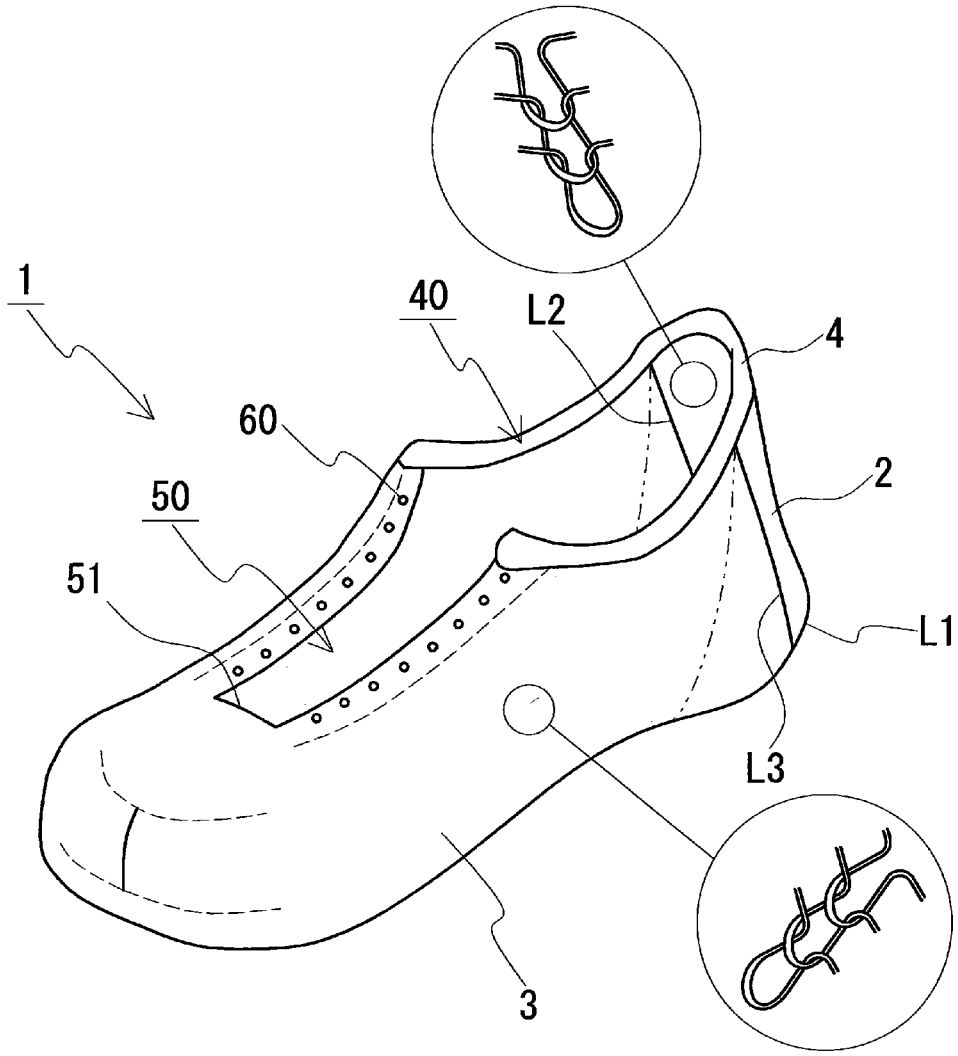
FIG. 1 is a schematic perspective view of a shoe upper shown in an embodiment.

A shoe upper 1 of the present embodiment shown in FIG. 1 is obtained by integrally knitting, in a seamless manner, a top section and a bottom section of the upper according to a special knitting procedure, and is entirely formed by a knitting pattern. It can be seen that the shoe upper 1 is knitted according to the special knitting procedure since the shoe upper 1 is divided into a heel cover portion 2 and a body portion 3, which are distinguishable by the direction of the stitches. The knitting pattern configuring the shoe upper 1 is not particularly limited, and may be, for example, a plain stitch structure, a mesh structure, a rib structure, or a mixed structure of the same.

The heel cover portion 2 of the shoe upper 1 is a portion from an upper end to a lower end of the top section of the upper at a position corresponding to a region between an Achilles' tendon and a heel of a wearer. The heel cover portion 2 has a predetermined width, for example, a knitting width of three or more stitches, and the direction of the stitches of the knitting pattern configuring the heel cover portion 2 is oriented in a height direction (downward direction) of the shoe upper (see circled enlarged view on the upper side).

The body portion 3 of the shoe upper 1 is configured by a portion excluding the heel cover portion 2 of the top section, and the bottom section of the upper. Among edges L1 to L3, which are boundary lines of the body portion 3 and the heel cover portion 2 described above, a starting end in a wale direction of the body portion 3 is connected in continuation to a terminating end in a wale direction of the heel cover portion 2 at the position of the edge L1 arranged in a bottom section region (region corresponding to the bottom section) of the shoe upper 1. At the positions of the edges L2, L3, a starting end in the wale direction of the body portion 3 is connected in continuation to an end (side end) in a knitting width direction of the heel cover portion 2. Thus, the direction of the stitches of the heel cover portion 2 is oriented in the height direction of the shoe upper 1, whereas the direction of the stitches of the body portion 3 is oriented in the length direction (forward direction) of the shoe upper 1 (see circled enlarged view on the lower side). Thus, the end in the knitting width direction of the heel cover portion 2 and the end in the wale direction of the body portion 3 are connected at the positions of the edges L2, L3, whereby the heel cover portion 2 and the body portion 3 are in a three-dimensionally connected state.

The instep side portion (i.e., instep side portion of the top section) of the body portion 3 is formed with a slit 50 extending from a reinforcement marginal section 4 toward the toe, so that the foot can be easily inserted from a foot insertion opening 40. An eyelet hole 60 for attaching eyelets, through which a shoelace is passed, is formed at positions sandwiching the slit 50 in the body portion 3.

In addition, the shoe upper 1 of the present embodiment includes the reinforcement marginal section 4. The reinforcement marginal section 4 is a knitting pattern arranged at a marginal portion in the vicinity of the foot insertion opening 40 of the shoe upper 1, that is, an upper end marginal portion of the top section, and is connected in a seamless manner to the body portion 3 and the heel cover portion 2. The reinforcement marginal section 4 mainly has a function of stabilizing the contour shape of the marginal portion of the top section in the vicinity of the foot insertion opening 40, and consequently, the shoe upper 1 in which the foot can be easily inserted from the foot insertion opening 40 can be obtained. The direction of the stitches of the reinforcement marginal section 4 reflects the knitting process to be described later, and is oriented in the same direction as the stitches of the heel cover portion 2.

Figure 2:
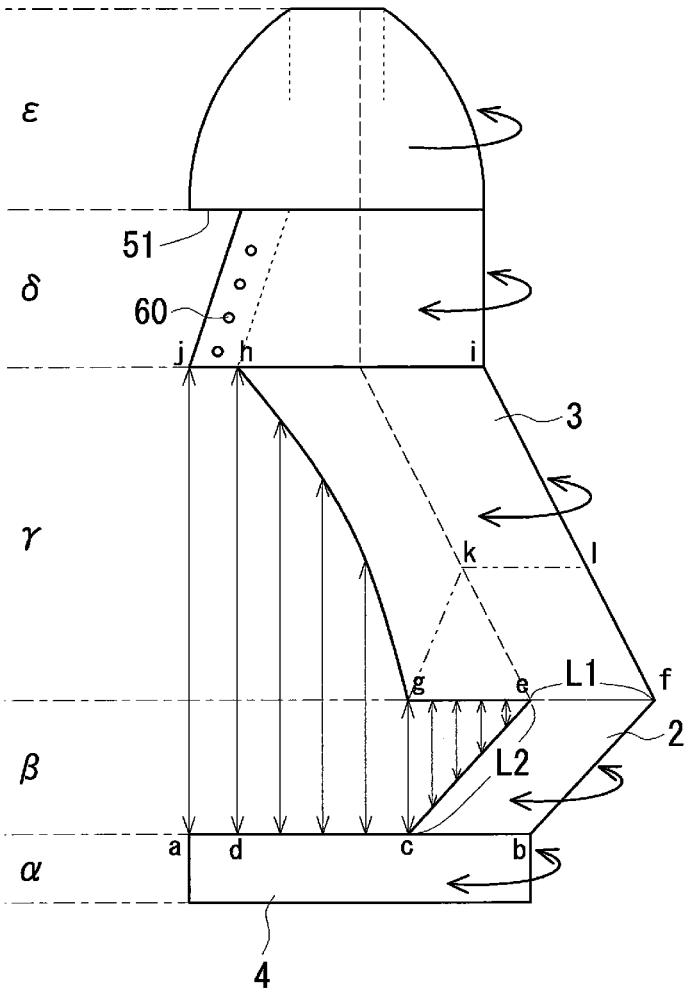
FIG. 2 is a knitting process image diagram schematically showing knitting processes of the shoe upper shown in FIG. 1.

The shoe upper 1 can be produced by knitting a right side portion of the shoe upper 1 with one needle bed of the flat knitting machine and knitting a left side portion with the other needle bed using a knitting yarn containing a thermoplastic resin and the like. FIG. 2 is a knitting image diagram schematically showing a knitting procedure of the right side portion of the shoe upper 1. The left side portion of the shoe upper 1 is assumed to be arranged on the far side in the plane of drawing of FIG. 2, and the right side portion and the left side portion of the shoe upper 1 are connected on the right side in the plane of drawing. The left side portion of the shoe upper 1 is knitted through knitting similar to the right side portion, and hence the description thereof will be omitted. Needless to say, the shape of the foot is left-right asymmetric, and thus the knitting width and the like of the right side portion and the left side portion of the shoe upper 1 are preferably changed in accordance with the shape of the foot.

In FIG. 2, the knitting is advanced from the lower side toward the upper side. The shoe upper 1 according to the present embodiment is knitted by being divided into five regions of a reinforcement marginal section region α, a heel region β, a main body back region γ, a main body front region δ, and a toe region ε. The region α corresponds to the reinforcement marginal section 4, the region β corresponds to the heel cover portion 2, and the regions γ to ε correspond to the body portion 3. Each region α to ε is basically knitted by a C-shaped knitting or a tubular knitting (arrow with an arrow head on both ends indicates C-shaped knitting, and arrow with an arrow head on one side indicates tubular knitting). A dash line of FIG. 2 represents the boundary of the top section and the bottom section, a dot line represents the portion where narrowing stitch is carried out, and a chain dashed line represents the boundary of the above regions α to ε, where lower case alphabets a to l are denoted to important positions of the knitting in FIG. 2. A chain double dashed line will be described in a modified embodiment, to be described later.

[Knitting of Reinforcement Marginal Section Region α]

In the knitting shown in FIG. 2, the C-shaped knitting is first carried out with the right side as a turn-back position to knit the reinforcement marginal section 4. That is, the reinforcement marginal section 4 held front and back is not connected at the position on the left side in the plane of drawing, and the slit 50 (see FIG. 1) is formed from such unconnected portion.

[Knitting of Heel Region β]

A plurality of stitch rows is knitted following the wale direction of some stitches of the reinforcement marginal section 4. Such stitch rows configure the heel cover portion 2. When knitting the plurality of stitch rows, the knitting of one to three stitch rows of the heel cover portion 2, and the transferring of the knitted stitch rows toward a side (right side) away from the reinforcement marginal section 4 are repeated. When knitting a new stitch row in continuation to the wale direction of the transferred stitch rows, a pickup stitch is formed at an end in the knitting width direction of the new stitch row. That is, the pickup stitches are lined on a line of the c-e in the drawing. After completing the heel cover portion 2 by repeating such knitting, the stitches of the a-c, the pickup stitches of the c-e, and the stitches of the e-f are held on the knitting needles of the needle beds. The stitches of the a-c are the stitches at the terminating end in the wale direction of the reinforcement marginal section 4, the pickup stitches of the c-e are the pickup stitches at the end in the knitting width direction of the heel cover portion 2 (correspond to edge L2 of FIG. 1), and the stitches of the e-f are the stitches at the terminating end in the wale direction of the heel cover portion 2 (correspond to right side portion of edge L1 of FIG. 1).

The knitting of the heel cover portion 2 is preferably carried out using a reinforcement knitting yarn. For example, the heel cover portion 2 may be knitted with the reinforcement knitting yarn in which a knitting yarn of high tension and a knitting yarn made of thermoplastic resin are twisted. In this case, after the shoe upper 1 is completed, the shoe upper 1 is subjected to thermal treatment, so that the heel cover portion 2 can be retained in a plate shape. The heel cover portion 2 retained in the plate shape serves the role of a heel counter provided in general shoes.

In addition, the heel cover portion 2 may be knitted so that the knitting width becomes wider from the upper end toward the lower end of the top section. In other words, the heel cover portion 2 is knitted while increasing the knitting width by split knitting and the like so that the width of the e-f becomes wider than the width of the c-b. The portion on the bottom section side of the heel cover portion 2 shown in FIG. 1 thus bulges out toward the back side of the shoe upper 1, so that the shoe upper 1 that conforms more with the shape of the region between the Achilles' tendon and the heel of the wearer can be obtained. This configuration is effective particularly when increasing the strength of the heel cover portion 2 with the reinforcement knitting yarn. The heel cover portion 2 with increased strength has poor stretchability, hence, when the knitting width of the heel cover portion 2 is the same from the upper end to the lower end, the heel of the shoe upper 1 becomes tight if the size of the foot insertion opening 40 of the shoe upper 1 shown in FIG. 1 is fitted to the size of the ankle, or the foot insertion opening 40 becomes too large with respect to the ankle if the size of the bottom section is fitted to the size of the heel. Such problems do not arise with the heel cover portion 2 in which the knitting width is increased from the upper end to the lower end.

[Knitting of Main Body Back Region γ]

Then, the knitting of the stitch row to become the body portion 3 following the wale direction of the pickup stitches (edge L2) of the c-e and the stitches (edge L1) of the e-f, and the transferring of the knitted stitch row to the side (left side) of the reinforcement marginal section 4 to overlap them with the stitches of the c-d are repeated. According to such knitting, the body portion 3 is knitted following the edges L1, L2, L3 of the heel cover portion 2 and the g-h of the main body back region γ of the body portion 3 is joined to the c-d of the reinforcement marginal section 4, as shown in FIG. 1. In this case, the starting end in the wale direction of the bottom section region of the body portion 3 is formed in continuation to the terminating end in the wale direction of the heel cover portion 2 at the edge L1, and the starting end in the wale direction of the top section region of the body portion 2 is formed following the pickup stitches formed at the end in the knitting width direction of the heel cover portion 2 at the edges L2, L3. That is, the knitting direction of the heel cover portion 2 and the knitting direction of the body portion 3 are substantially orthogonal at the edges L2, L3, so that the heel cover portion 2 and the body portion 3 are in a three-dimensionally connected state.

In the present embodiment, when increasing the number of stitch rows configuring the main body back region γ of the body portion 3, the knitting width of the stitch row is reduced, and thereafter, the knitting width of the stitch row is increased. In this manner, the portion corresponding to the ankle of the wearer in the reinforcement marginal section 4 is curved toward the bottom section side to avoid the ankle, as shown in FIG. 1 (see also g-h of FIG. 2). The curved shape is formed by increasing/decreasing the number of stitches in the knitting width direction of the body portion 3 at the position (position of g-h of FIG. 2) on the foot insertion opening side. Thus, the stitches configuring the body portion 3 are aligned straight from the heel cover portion 2 toward the toe portion. If the stitches are increased/decreased within the knitting width of the body portion, the directions of the stitches become misaligned thus impairing the appearance of the shoe upper 1.

The increase/decrease of the stitches in the main body back region γ is preferably differed between the right side portion and the left side portion of the shoe upper 1 (similarly in the main body front part region δ and the toe region ε to be described later). For example, the shapes of the right side portion and the left side portion are changed in view of the three-dimensional shape of the foot such as making the height of the portion on the big toe side in the shoe upper 1 higher than the portion on the little toe side. In this case, the stitches are preferably increased/decreased in the instep side portion of the top section region of the body portion 3 and the bottom section region. The directions of the stitches at the side surface of the shoe upper 1 thus can be aligned, and satisfactory appearance of the shoe upper 1 can be obtained.

[Main Body Front Region δ]

Next, a plurality of stitch rows to become the main body front region δ of the body portion 3 is knitted following the wale direction of the stitches of the a-d(h)-i. In this case, the knitting width of the stitch row is reduced at the position of the dotted line toward the toe region ε, so that the main body front region δ can be formed to a tapered shape along the shape of the foot.

Furthermore, in the present embodiment, the eyelet hole 60 is formed at the position in the vicinity of the slit 50 (see FIG. 1) when knitting the main body front region δ. The eyelet hole 60 can be formed through the known mesh knitting, miss knitting, and the like.

[Knitting of Toe Region ε]

When knitting the toe region ε, the portion to become a cut end 51 of the slit 50 (see FIG. 1) is set up through the C-shaped knitting. Next, the tubular knitting is carried out in continuation to the wale direction of the stitch row of the terminating end in the wale direction of the main body front region δ and the stitch row of the portion to become the cut end 51 to knit the toe region ε. In this case, the knitting width is reduced by narrowing stitch at the position of the instep side of the top section region and the position of the bottom section region shown with a dotted line (see also dotted line of FIG. 1), and lastly, the distal end is closed together. Thus, as shown in FIG. 1, the distal end of the shoe upper 1 can be formed to a tapered shape along the shape of the foot. The position of carrying out the narrowing stitch is aligned with a line parallel to the ground, so that the directions of the stitches in the distal end region ε can be beautifully aligned, and the appearance of the shoe upper 1 can be improved.

After the knitting of the shoe upper 1 is terminated, a tongue (not shown) is attached to the inner side of the slit 50 of the top section and the outer sole (not shown) is joined to the bottom section. The eyelets (not shown) are attached to the eyelet hole 60, and the shoelace is passed through the eyelets to complete the shoes. The tongue can be integrally formed with the shoe upper 1 by the flat knitting machine. In this case, a set up section is to be knitted when knitting the vicinity of the cut end 51, and the tongue is knitted following such set up section. Furthermore, when producing shoes to be used indoor, the outer sole does not need to be attached to the shoe upper 1. In this case, the bottom section is to have a thick knitting pattern.

As described above, the shoe upper 1 of the present embodiment is obtained by integrally knitting the top section and the bottom section in a seamless manner, and thus excels in productivity. When connecting the outer sole to the shoe upper 1, the shoe upper 1 made of knitted fabric is already held in a three-dimensional shape, and hence the alignment of the bottom section of the shoe upper 1 and the outer sole is facilitated and the shoe upper 1 is less likely to lose shape, whereby the connecting task itself is also facilitated. Furthermore, the stitches of the heel cover portion 2 of the shoe upper 1 are oriented in the height direction of the shoe upper 1 and the stitches of the body portion 3 are oriented in the length direction of the shoe upper 1, whereby satisfactory appearance of the shoe upper 1 is obtained. In particular, the appearance of the shoe upper 1 can be further enhanced by aligning the directions of the stitches in the body portion 3.

Second Embodiment

In the first embodiment, the knitting is started from the reinforcement marginal section 4, and after the heel cover portion 2 is knitted, the body portion 3 is knitted from the main body back region γ toward the toe region ε following the heel cover portion 3. On the contrary, the body portion 3 may be knitted from the toe region ε toward the main body back region γ, and thereafter, the heel cover portion 2 may be knitted following the body portion 3, and the reinforcement marginal section 4 may be knitted last. In this case, the shoe upper 1 may be knitted through substantially the reverse procedures of FIG. 2. This will be specifically described below.

First, the set up section is formed on the needle bed, and the toe region ε is knitted following such set up section. Next, the bind-off process is performed on the portion to become the cut end 51 of the terminating end in the wale direction of the toe region ε to knit the main body front region δ following the other portion. The knitting of the stitch row of the main body back region γ following the h-j of the main body front region δ and the moving of the knitted stitch rows toward the right side in the plane of drawing are repeated to complete the body portion 3. In the knitting of the main body back region γ, when knitting a new stitch row following the stitch rows moved toward the right side in the plane of drawing, the pickup stitch is formed at the end in the knitting width direction of the stitch row. Accordingly, the pickup stitches are lined along the line of the h-g, and the stitch rows can be formed following the end in the knitting width direction of the main body back region γ. The line of the h-g can be curved by appropriately increasing/decreasing the knitting width in the knitting of the main body back region γ. The curved line is formed so that the body portion 3 does not interfere with the ankle of the wearer, similar to the first embodiment.

At the time point the knitting of the main body back region γ is finished, the stitches of the j-h (stitches at the terminating end in the wale direction of the main body front region δ), the pickup stitches of the h-g (pickup stitches at the end in the knitting width direction of the main body back region γ), and the stitches of the g-e-f (stitches at the terminating end in the wale direction of the main body back region γ) are held on the needle beds. Among such stitches, the stitches of the g-e correspond to the edge L2, and the stitches of the e-f correspond to the right side portion of the edge L1. Then, the stitches at the end in the knitting width direction of the heel cover portion 2 are joined to the stitches of the body portion 3 of the e-g while knitting the heel cover portion 2 following the wale direction of the edge L1. That is, the terminating end in the wale direction of the bottom section region of the body portion 3 and the starting end in the wale direction of the heel cover portion 2 are connected at the position of the edge L1, and the terminating end in the wale direction of the top section region of the body portion 3 and the end (side end) in the knitting width direction of the heel cover portion 2 are connected at the positions of the edges L2, L3. As a result, the heel cover portion 2 and the body portion 3 are in a three-dimensionally connected state.

After the knitting of the heel cover portion 2 is finished, the stitches of the j-h-c(g)-b are held on one needle bed, and hence the reinforcement marginal section 4 is knitted following the wale direction of such stitches. As a result, the three-dimensional shoe upper 1 in which the directions of the stitches of the heel cover portion 2 and the reinforcement marginal section 4 are oriented in the height direction (upward) of the shoe upper 1 and the directions of the stitches of the body portion 3 are oriented in the length direction (backward) of the shoe upper 1 can be knitted in a seamless manner, similar to the first embodiment.

Modified Embodiment

In the shoe upper 1 of the first and second embodiments, the heel counter knitted with the reinforcement knitting yarn may be extended up to a part of the body portion 3 (e.g., portion of chain double dashed line of FIG. 1). In this case, when knitting the main body back region γ shown in FIG. 2, intarsia knitting is carried out so that the reinforcement knitting yarn is interwoven to the square portion surrounded by the e-k-l-f of the bottom section region of the body portion 3 and the triangular portion surrounded by the e-k-g of the top section region of the body portion 3. The following three portions thus become the heel counter.

(1) heel cover portion 2

(2) portion connecting to the heel cover portion 2 in the bottom section region of the body portion 3, the portion having a predetermined length from the heel cover portion 2

(3) portion connecting to the heel cover portion 2 in the top section region of the body portion 3, the portion being a substantially triangular portion widened from the upper end side toward the lower end side The heel counter having the above shape has a shape similar to the heel counter formed in sport shoes and the like, and the comfort of the shoes can be improved by forming the heel counter having such shape in the shoe upper.

Furthermore, in the embodiments, the shoe upper of a shoelace type with a shoelace has been described, but a shoe upper of a step-in type without a shoelace may be realized. In this case, the reinforcement marginal section 4 is formed to a tubular shape, and the slit 50 extending from the reinforcement marginal section 4 to the toe is not to be formed when knitting the body portion 3.

In addition, when knitting the shoe upper 1, the reinforcement marginal section 4 may not be knitted. In this case, after completing the shoe upper 1 without the reinforcement marginal section 4, a reinforcement material made from resin and the like is preferably attached to the marginal portion of the foot insertion opening 40, or the reinforcement marginal section 4 knitted separate from the shoe upper 1 is preferably joined.

REFERENCE SIGN LIST

1 shoe upper
2 heel cover portion L1, L2, L3 edge
3 body portion
4 reinforcement marginal section
40 foot insertion opening
50 slit
51 cut end
60 eyelet hole

The invention claimed is:

1. A method for producing a shoe upper which comprises a top section and a bottom section, wherein said top section comprises a heel cover portion having a knitting width greater than or equal to a predetermined width from an upper end to a lower end of the top section, wherein said heel cover portion is at a position in said shoe upper corresponding to a region between an Achilles' tendon and a heel of a wearer, and a portion including a remaining portion of the top section, excluding the heel cover portion, and the bottom section comprises a body portion, and the shoe upper further comprises a reinforcement marginal section that is connected in a seamless manner to the body portion and the heel cover portion at an upper end marginal portion of the top section, and that is a knitting pattern forming a marginal portion of a foot insertion opening of the shoe upper, wherein a flat knitting machine which includes at least a pair of a front and a back needle bed is used, wherein stitches formed on each of the needle beds are transferrable between the front and back needle beds; the method comprising: [1] sequentially performing knitting the reinforcement marginal section, knitting the heel cover portion so that pickup stitches are held on the needle beds by repeating knitting of a stitch row configuring the heel cover portion following a wale direction of some stitches of the reinforcement marginal section and transferring of the knitted stitch row toward a side away from the reinforcement marginal section in a knitting width direction, and, while repeating the knitting and the transferring, forming the pickup stitches at an end in the knitting width direction of the heel cover portion, knitting a starting end in a wale direction of a bottom section region of the body portion following a terminating end in a wale direction of the heel cover portion, and knitting a starting end in a wale direction of a top section region of the body portion following the pickup stitches at the end in the knitting width direction of the heel cover portion and, knitting and transferring a stitch row of a main body back region (γ) of the body portion so that an end in a knitting width direction of the main body back region (γ) is joined to a remaining portion at a terminating end in a wale direction of the reinforcement marginal section, knitting a main body front region (δ) following a terminating end in a wale direction of the main body back region (γ) and knitting a toe region (ε) of the body portion following a terminating end in a wale direction of the main body front region (δ); or [2] sequentially performing knitting a toe region (ε) of the body portion, knitting a main body front region (δ) following a terminating end in a wale direction of the toe region (ε), knitting a main body back region (γ) so that pickup stitches are held on the needle beds by repeating knitting of a stitch row of the main body back region (γ) of the body portion following a terminating end in a wale direction of the main body front region (ε) and transferring of the knitted stitch row in a knitting width direction, and while repeating the knitting and the transferring, forming the pickup stitches at an end in the knitting width direction of the main body back region (γ), knitting a stitch row configuring the heel cover portion following a terminating end in a wale direction of a bottom section region of the main body back region (γ) and transferring the knitted stitch row so that an end in a knitting width direction of the heel cover portion is joined to a terminating end in a wale direction of a top section region of the main body back region, knitting the reinforcement marginal section following the pickup stitches at the end in the knitting width direction of main body back region (γ) and a terminating end in a wale direction of the heel cover portion; wherein either of [1] and [2] is performed so that stitches at the end in the knitting width direction of the stitch rows configuring the heel cover portion are aligned in the wale direction of the heel cover portion, and stitches at the starting end or the terminating end in the wale direction of the body portion are lined along an entire length of a side end of the heel cover portion.

2. The method according to claim 1, wherein the shoe upper includes a portion corresponding to an ankle of the wearer on an upper end side of the body portion, which is curved toward a lower end side of the body portion to avoid the ankle; and the curved shape is formed by reducing the number of stitches in the knitting width direction of the body portion at a position on the upper end side.

3. The method according to claim 1, wherein the heel cover portion is formed by a reinforcement knitting yarn for increasing strength of the heel cover portion; and a portion adjacent to the heel cover portion in the body portion is formed by intarsia knitting using the reinforcement knitting yarn.

4. The method according to claim 1, wherein the body portion is formed to be left-right asymmetric to become a shape that lies along an entire shape of a foot of the wearer; wherein the left-right asymmetrical shape is formed by changing the number of stitches in a knitting width direction in an instep side portion of a top section region and a bottom section region of the body portion.

* * * * *